US009230721B2

(12) United States Patent
Yu et al.

(10) Patent No.: US 9,230,721 B2
(45) Date of Patent: Jan. 5, 2016

(54) METHOD FOR PREPARING R-FE-B-BASED RARE EARTH MAGNETIC POWDER FOR A BONDED MAGNET, MAGNETIC POWDER PREPARED BY THE METHOD, METHOD FOR PRODUCING A BONDED MAGNET USING THE MAGNETIC POWDER, AND BONDED MAGNET PRODUCED BY THE METHOD

(75) Inventors: Ji-Hun Yu, Busan (KR); Dongwon Lee, Gyeongsangnam-do (KR); Junggoo Lee, Gyeongsangnam-do (KR)

(73) Assignee: Korea Institute of Machinery and Materials, Daejeon (KR)

( * ) Notice: Subject to any disclaimer, the term of this patent is extended or adjusted under 35 U.S.C. 154(b) by 373 days.

(21) Appl. No.: 13/807,994

(22) PCT Filed: Jul. 1, 2011

(86) PCT No.: PCT/KR2011/004863

§ 371 (c)(1),
(2), (4) Date: Mar. 13, 2013

(87) PCT Pub. No.: WO2012/002774

PCT Pub. Date: Jan. 5, 2012

(65) Prior Publication Data

US 2013/0320585 A1 Dec. 5, 2013

(30) Foreign Application Priority Data

Jul. 2, 2010 (KR) ..... 10-2010-0063900

(51) Int. Cl.

| | |
|---|---|
| ***B28B 1/14*** | (2006.01) |
| ***B28B 1/24*** | (2006.01) |
| ***H01F 1/01*** | (2006.01) |
| ***B22F 9/02*** | (2006.01) |
| ***C22C 33/02*** | (2006.01) |
| ***C22C 38/00*** | (2006.01) |
| ***C22C 1/02*** | (2006.01) |
| *H01F 1/057* | (2006.01) |

(52) U.S. Cl.

CPC *H01F 1/01* (2013.01); *B22F 9/023* (2013.01); *C22C 1/02* (2013.01); *C22C 33/0278* (2013.01); *C22C 38/002* (2013.01); *C22C 38/005* (2013.01); *H01F 1/0578* (2013.01); *H01F 1/0573* (2013.01)

(58) Field of Classification Search

USPC ..... 264/611–613, 620, 652, 654, 655, 671, 264/673, 678, 128

See application file for complete search history.

(56) References Cited

U.S. PATENT DOCUMENTS

| | | | | |
|---|---|---|---|---|
| 5,486,239 | A * | 1/1996 | Nakayama et al. | 148/101 |
| 6,709,533 | B2 * | 3/2004 | Honkura et al. | 148/105 |

FOREIGN PATENT DOCUMENTS

| | | | |
|---|---|---|---|
| JP | 3250551 | B2 | 11/2001 |
| JP | 2002093610 | A | 3/2002 |
| KR | 1020050065612 | A | 6/2005 |
| KR | 1020110062917 | A | 6/2011 |

OTHER PUBLICATIONS

International Search Report dated Jan. 2, 2012, as issued in corresponding International Patent Application No. PCT/KR2011/004863, filed Jul. 1, 2011.

* cited by examiner

*Primary Examiner* — Sing P Chan
(74) *Attorney, Agent, or Firm* — Maier & Maier, PLLC

(57) ABSTRACT

A method of preparing R—Fe—B-based rare earth magnetic powder for a bonded magnet and magnetic powder prepared thereby, and a method of manufacturing a bonded magnet using magnetic powder and a bonded magnet manufactured thereby. Further, a method of preparing R—Fe—B-based rare earth magnetic powder having improved magnetic properties including grinding rare earth sintered magnet products as a raw material, performing a hydrogenation process where a ground product is charged into a furnace, and the furnace is then filled with hydrogen and a temperature of the furnace is increased, performing a disproportionation process where the temperature of the furnace is further increased in the same hydrogen atmosphere above, performing a desorption process where hydrogen is exhausted from an inside of the furnace, and performing a recombination process where hydrogen in the inside of the furnace is exhausted, and magnetic powder prepared thereby, and a method of manufacturing a bonded magnet.

18 Claims, 5 Drawing Sheets

METHOD FOR PREPARING R-FE-B-BASED RARE EARTH MAGNETIC POWDER FOR A BONDED MAGNET, MAGNETIC POWDER PREPARED BY THE METHOD, METHOD FOR PRODUCING A BONDED MAGNET USING THE MAGNETIC POWDER, AND BONDED MAGNET PRODUCED BY THE METHOD

RELATED APPLICATIONS

This is the U.S. national stage application which claims priority under 35 U.S.C. §371 to International Patent Application No.: PCT/KR20111004863, filed on Jul. 1, 2011, which claims priority to Korean Patent Application No. 10-2010-0063900, filed on Jul. 2, 2010, the disclosures of which are incorporated by reference herein their entireties.

TECHNICAL FIELD

The present disclosure relates to a method of preparing R—Fe—B-based rare earth magnetic powder for a bonded magnet and magnetic powder prepared thereby, and a method of manufacturing a bonded magnet using the magnetic powder and a bonded magnet manufactured thereby.

BACKGROUND ART

In line with recent rapid emergence of energy reduction and environmentally-friendly green growth industries as a new issue, research into hybrid vehicles using internal combustion engines along with motors or fuel cell vehicles utilizing hydrogen, an environmentally-friendly energy source, as alternative energy, to generate electricity and drive motors have been actively conducted in automotive industries. Since these environmentally-friendly vehicles are driven by electric energy, permanent magnet type motors and generators are inevitably employed, and technical demands for rare earth permanent magnets exhibiting better hard magnetic performance tend to be increased in order to further increase energy efficiency in terms of magnetic materials.

Also, in other aspects for improving fuel economy of automobiles, weight reductions and miniaturization of automotive parts must be realized, and for example, with respect to motors, it is essential to replace permanent magnet materials with rare earth magnets exhibiting magnetic properties better than those of typically used ferrites along with design changes of the motors, in order to realize the weight reductions and miniaturization.

Residual magnetic flux density of a permanent magnet is theoretically determined by conditions, such as saturation magnetic flux density of a main phase constituting a material thereof, a degree of anisotropy of grains, and density of the magnet. Since the magnet may generate stronger magnetic force toward the outside as the residual magnetic flux density increases, efficiency and performance of devices may be improved in various applications. Also, since coercive force among magnetic properties of the permanent magnet acts to maintain inherent performance of the permanent magnet corresponding to environments demagnetizing the magnet, such as heat, a magnetic field in an opposite direction, and mechanical shock, environmental resistance is good when the coercive force is excellent, and thus, the magnet may not only be used in devices for high-temperature application and high-power devices, but the thickness thereof may also be decreased. Therefore, the weight thereof may be reduced to increase its economic value. R—Fe—B-based rare earth magnets have been known as permanent magnetic materials exhibiting excellent magnetic performance.

However, since expensive rare earth elements are used as main raw materials for rare earth permanent magnets, manufacturing costs thereof are higher than those of ferrite magnets, and thus, the price of a motor may not only increase as the rare earth permanent magnets are employed, but there may also be limiting factors of resources in which reserves of the rare earth elements are not abundant in comparison to those of other metals. Therefore, there is a need to invent a method of manufacturing low-cost magnets by recycling wasted rare earth magnets in order to expand applications of rare earth magnets and address limitations in supply and demand.

Meanwhile, R—Fe—B-based rare earth magnets are manufactured in the form of a sintered magnet or bonded magnet by using R—Fe—B alloys as a starting raw material. Rare earth sintered magnets are manufactured by general powder metallurgical processes and machining, and scraps in an amount ranging from about 30% to 40% are generated during the manufacturing processes (annual amount of scrap generated based on 2008: 58,000 ton/year×0.35=20,300 ton/year). However, since almost of these expansive rare earth magnet scraps may not be reused and a process of extracting rare earth elements only by refining may be performed, additional processing costs for recycling may be required.

Therefore, attempts to recycle low-cost stating materials, such as process scraps generated during the foregoing manufacturing processes of rare earth sintered magnets and rare earth sintered magnet products recovered from defective products or wasted products, as powders for low-cost rare earth bonded magnets have been underway. According to typical techniques used in the art, these rare earth scraps are ground and prepared as powder having a diameter ranging from 50 μm to 500 μm and the powder is then mixed with a thermosetting resin, such as epoxy, to manufacture rare earth bonded magnets through a forming process and a curing process at a temperature ranging from 100° C. to 150° C.

However, when rare earth powder and bonded magnets are prepared by the foregoing processes, magnetic defects, such as oxidation or mechanical residual stress during the grinding process, may be generated, and as a result, coercive force may be decreased with inversely proportional to a particle diameter of the powder. In particular, limitations in quality may occur, in which characteristics of the magnets may become unstable as effects of magnetic defects on the surfaces thereof may be further increased when the curing process at a temperature ranging from 100° C. to 150° C. is performed.

The present invention uses rare earth sintered magnet scraps as a staring raw material in order to significantly reduce manufacturing costs in manufacturing R—Fe—B-based powders for bonded magnets and aims at improving coercive force and thermal stability of the powders by using an improved Hydrogenation-Disproportionation-Desorption-Recombination (HDDR) method. Further, a method of preparing powder for a rare earth bonded magnet has been devised, in which R—Fe—B-based anisotropic powder having excellent magnetic performance, stable production, and uniform quality is prepared by using low-cost stating materials, such as process scraps generated during the foregoing manufacturing processes of rare earth sintered magnets and rare earth sintered magnet products recovered from defective products or wasted products, and the improved HDDR method, i.e., a method in which hydrogenation, disproportionation, and desorption processes are performed, and then the disproportionation and desorption processes are again repeatedly performed (Korea Patent Application No. 10-2009-0119785) and a recombination process is completed.

DISCLOSURE OF THE INVENTION

Technical Problem

One object of the present invention is to provide a method of preparing R—Fe—B-based rare earth magnetic powder for a bonded magnet by using wasted scraps and magnetic powder prepared thereby, and a method of manufacturing a bonded magnet using the magnetic powder and a bonded magnet manufactured thereby.

Technical Solution

In order to achieve the objects, the present invention provides a method of preparing R—Fe—B-based rare earth magnetic powder having improved magnetic properties including:

coarse grinding rare earth sintered magnet products as a raw material (step 1);

performing a hydrogenation process in which a ground product obtained through step 1 is charged into a tube furnace, and the tube furnace is then filled with hydrogen and a temperature of the tube furnace is increased (step 2);

performing a disproportionation process in which the temperature of the tube furnace is further increased in the same hydrogen atmosphere as that of step 2 (step 3);

performing a desorption process in which hydrogen is exhausted from an inside of the tube furnace of step 3 (step 4); and performing a recombination process in which hydrogen in the inside of the tube furnace is vacuum exhausted after step 4 is performed (step 5), and magnetic powder prepared thereby, and a method of manufacturing a bonded magnet using the magnetic powder and a bonded magnet manufactured thereby.

Advantageous Effects

A method of preparing R—Fe—B-based rare earth magnetic powder for a bonded magnet according to the present invention has an effect of improving magnetic properties through the preparation of magnetic powder having a fine size and an uniform composition by using a low-cost starting raw material and separately performing a desorption process and a recombination process in a Hydrogenation-Disproportionation-Desorption-Recombination (HDDR) process and controlling the desorption of hydrogen gas, and also has advantages in price and environmental aspects by recycling low-cost wasted scraps.

MODE FOR CARRYING OUT THE INVENTION

Figure 1:
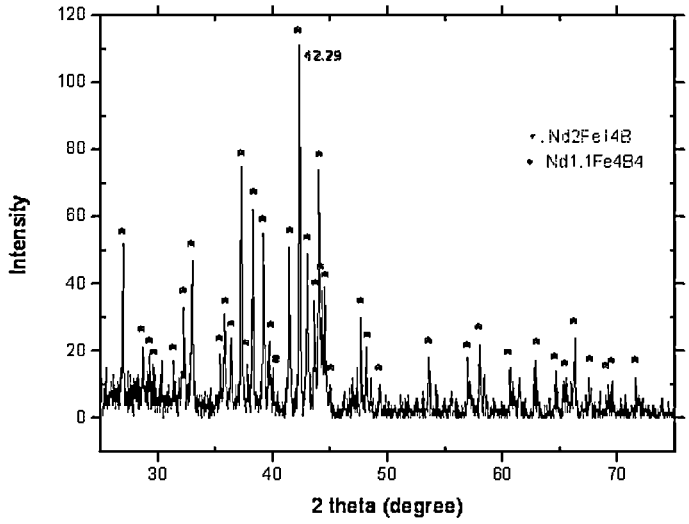
FIG. 1 is a graph obtained from X-ray diffraction analysis of R—Fe—B-based rare earth magnetic powder before performing a hydrogenation process.

Hereinafter, the present invention will be described in detail.

The present invention provides a method of preparing R—Fe—B-based rare earth magnetic powder having improved magnetic properties including:

coarse grinding rare earth sintered magnet products as a raw material (step 1);

performing a hydrogenation process in which a ground product obtained through step 1 is charged into a tube furnace, and the tube furnace is then filled with hydrogen and a temperature of the tube furnace is increased (step 2);

performing a disproportionation process in which the temperature of the tube furnace is further increased in the same hydrogen atmosphere as that of step 2 (step 3);

performing a desorption process in which hydrogen is exhausted from an inside of the tube furnace of step 3 (step 4); and performing a recombination process in which hydrogen in the inside of the tube furnace is vacuum exhausted after step 4 is performed (step 5).

Hereinafter, the method of preparing R—Fe—B-based rare earth magnetic powder according to the present invention will be described in detail for each step.

In the method of preparing R—Fe—B-based rare earth magnetic powder according to the present invention, step 1 is a step of coarse grinding process scraps generated during manufacturing processes of rare earth sintered magnets and R—Fe—B-based rare earth sintered magnet products recovered from defective products or wasted products.

Since the rare earth sintered magnet scraps used as a starting raw material in step 1 are already prepared through a sintering process, the scraps have a microstructure in which a main $R_2Fe_{14}B$ phase and an auxiliary R-rich phase are uniformly distributed, and since the scraps generally do not contain α-Fe, a soft magnetic phase, a separate homogenization process is not performed.

At this time, R denotes rare earth elements, a common designation of 17 elements in the periodic table, and includes scandium, yttrium, and lanthanides, and may include actinides.

In the coarse grinding of step 1, R—Fe—B-based rare earth sintered magnet scraps may be ground to a diameter ranging from 0.1 μm to 10,000 μm. In the case that the sintered magnet scraps are coarse ground to a diameter of less than 0.1 μm, a surface area of powder increases and thus, the powder may be excessively exposed to oxygen during a Hydrogenation-Disproportionation-Desorption-Recombination (HDDR) process. In the case in which the sintered magnet scraps are coarse ground to a diameter of greater than 10,000 μm, cracks may occur inside the powder due to volume expansion and contraction caused by phase transition during the HDDR process.

Step 2 of the present invention is a hydrogenation process step in which a ground product obtained through step 1 is charged into a tube furnace, and the tube furnace in vacuum is then filled with hydrogen and a temperature of the tube furnace is increased.

According to phase analysis performed by X-ray diffraction analysis, the scraps used as a starting raw material of the present invention were composed of a $R_2Fe_{14}B$ phase and a R-rich phase. However, these phases were combined with hydrogen through the hydrogenation process of step 2 to form hydrogen compounds, $R_2Fe_{14}BH_x$ and $RH_x$, and this may be confirmed through the following Experimental Example 1.

At this time, a vacuum state in step 2 may be maintained at a pressure of $2\times10^{-2}$ Torr or less and hydrogen may then be filled to a pressure ranging from 0.3 atm to 2.0 atm. In the case that the pressure of hydrogen is less than 0.3 atm, reactions of the HDDR process may not sufficiently occur, and in the case that the pressure of hydrogen is greater than 2.0 atm, separate equipment must be set up for handling high-pressure hydrogen gas and thus, processing costs may increase.

Also, the temperature of the tube furnace in step 2 may be increased to a range of 100° C. to 400° C. In the case that the temperature is less than 100° C., hydrogen compounds, $R_2Fe_{14}BHx$ and RHx, may not be sufficiently formed, and in the case in which the temperature is greater than 400° C., an excessive amount of energy may be consumed in terms of energy efficiency. Further, the higher the pressure of the hydrogen gas is, the higher the reaction temperature for being combined with hydrogen is, and thus, a temperature for stably forming hydrogen compounds may be decreased.

Step 3 of the present invention is a disproportionation process step in which the temperature of the tube furnace is further increased in the same hydrogen atmosphere as that of step 2.

The disproportionation step is a process for realizing refinement and anisotropy of particles, in which a temperature of the powder having hydrogen compounds, $R_2Fe_{14}BH_x$ and $RH_x$, is further increased to a range of 700° C. to 900° C. at the same hydrogen pressure as that of the hydrogenation process after the hydrogenation process of step 2, and thus, the powder having hydrogen compounds further absorbs hydrogen to decompose into three phases completely different from phases constituting the initial scrap as illustrated in the following Reaction Formula 1.

$$R_2Fe_{14}BH_x+RH_x+H_2\rightarrow\alpha\text{-}Fe+Fe_2B+RH_x \qquad \text{<Reaction Formula 1>}$$

At this time, in the case that the temperature is less than 700° C., disproportionation may not occur, and in the case in which the temperature is greater than 900° C., grains of the disproportionated phase may grow to deteriorate magnetic properties. When the disproportionation process is not completely performed, coarse grains of the initial master alloy may be continuously maintained and thus, coercive force of the permanent magnet powder may be decreased. Variables determining the disproportionation process may include a reaction temperature and a pressure of hydrogen gas, and an optimum condition of the reaction variables may be changed according to the compositions of the initial scraps and a degree of contamination of impurities such as oxygen.

At this time, the disproportionation process may be performed for 30 minutes to 180 minutes due to the same reason as that of limiting the temperature. In the case that the time is less than 30 minutes, the disproportionation may not occur properly, and in the case in which the time is greater than 180 minutes, grains of the disproportionated phase may grow to deteriorate magnetic properties.

Step 4 of the present invention is a desorption process step in which hydrogen is exhausted from an inside of the tube furnace at the same temperature as that of step 3.

The desorption process may have an effect of uniformly distributing disproportionated phases, α-Fe, $Fe_2B$, and $RH_x$, having the disproportionation process completed in step 3. At this time, the desorption process may be performed to exhaust hydrogen gas for 1 minute to 30 minutes so as to obtain a pressure of hydrogen ranging from 1 Torr to 400 Torr. In the case that the pressure of hydrogen is greater than 400 Torr, desorption may not be sufficient, and in the case that the pressure of hydrogen is less than 1 Torr, the disproportionated phases may grow into coarse grains.

Also, according to the same reason as that of limiting the pressure of hydrogen, in the case that the exhaust time is less than 1 minute, desorption may not be sufficient, and in the case in which the exhaust time is greater than 30 minutes, coarse grains may be grown.

In the preparation method of the present invention, steps 3 and 4 may be repeatedly performed and as a result, there may be an effect of providing better magnetic properties, stable production, and stable quality in comparison to a typical method of preparing R—Fe—B-based anisotropy powder for an anisotropic bonded magnet.

At this time, step 3 and step 4, for example, may be repeated in a range of one to ten times. As a result, even some coarse grains may be refined and the coercive force may be improved to a range of 15% to 20%.

Step 5 of the present invention is a recombination process step in which hydrogen in the inside of the tube furnace is vacuum exhausted after step 4 is performed. The disproportionated phases discharge hydrogen through this step and simultaneously, recombination into the phases constituting the initial alloy ingot is performed as in the following Reaction Formula 2. As a result, a grain refinement phenomenon occurs, in which a grain diameter of the $R_2Fe_{14}B$ phase, a main phase, is decreased to a level of a few hundreds nm after the HDDR reaction from a range of a few hundreds μm to a few mm before the HDDR reaction, and this corresponds to a grain diameter approaching 200 nm to 300 nm, a diameter of a single magnetic domain of $R_2Fe_{14}B$.

$$\alpha\text{-}Fe+Fe_2B+RH_x\rightarrow R_2Fe_{14}B+\text{R-rich}+H_2 \qquad \text{<Reaction Formula 2>}$$

In the recombination process, exhaustion may be performed to obtain a pressure of hydrogen in the tube furnace in a range of $10^{-5}$ Torr to $10^{-1}$ Torr. In the case that the pressure is greater than $10^{-1}$ Torr, the disproportionated phases may remain to deteriorate magnetic properties, and since the recombined phases are completely formed at $10^{-5}$ Torr, there is no need to vacuum exhaust at a pressure less than $10^{-5}$ Torr.

The present invention also provides R—Fe—B-based rare earth magnetic powder prepared according to the foregoing preparation method.

The disproportionation process of Reaction Formula 1 is completed and the magnetic powder is then formed by the recombination of the disproportionated phases according to Reaction Formula 2. As a result, a grain refinement phenomenon occurs, in which a grain diameter of the $R_2Fe_{14}B$ phase, a main phase, is decreased to a level of a few hundreds nm after the HDDR reaction from a range of a few hundreds μm to a few mm before the HDDR reaction, and thus, grains having a diameter approaching 200 nm to 600 nm, a diameter of a single magnetic domain of $R_2Fe_{14}B$, may be obtained.

Further, the present invention provides a method of manufacturing an R—Fe—B-based rare earth bonded magnet including:

grinding R—Fe—B-based rare earth magnetic powder prepared by using the foregoing preparation method to form powder (step 1);

mixing the powder of step 1 with a thermosetting or thermoplastic synthetic resin to form a mixture (step 2); and molding the mixture of step 2 to form a compression or injection-molded bonded magnet (step 3).

Step 1 of the method of manufacturing a bonded magnet is a step of grinding R—Fe—B-based rare earth magnetic powder by using a grinder to form powder.

At this time, a particle diameter of the magnetic powder may be in a range of 50 μm to 1000 μm. In the case that the particle diameter is less than 50 μm, a surface area increases and properties may be deteriorated due to oxidation during the manufacturing of the magnet. In the case in which the particle diameter is greater than 1000 μm, a small magnet may not be manufactured, fluidity may be decreased, and green density may be decreased.

Step 2 of the method of manufacturing a bonded magnet is a step of mixing the ground magnetic powder in step 1 with a thermosetting and thermoplastic synthetic resin to form a mixture.

Selection of the synthetic resin is determined by the method of manufacturing a bonded magnet and with respect to a compression bonded magnet, a thermosetting resin, such as an epoxy-based resin, a phenol-based resin, and a urea-based resin, may be suitable, and with respect to an injection-molded bonded magnet, a thermoplastic resin such as a nylon resin may be used.

In general, a compression method may be suitable for manufacturing a high-density magnet, and the synthetic resin added during the manufacturing of a compression bonded magnet may be added in an amount ranging from 1 wt % to 10 wt % based on a total weight of the bonded magnet. In the case that the addition amount is less than 1 wt %, bonding force may be decreased because the resin may not completely cover the powder, and in the case that the addition amount is greater than 10 wt %, the green density of the magnet may be decreased.

Step 3 of the method of manufacturing a bonded magnet is a step of molding the mixture of step 2 to form a bonded magnet.

Through Step 3, an R—Fe—B-based rare earth bonded magnet having desired shape and improved magnetic force may be formed from the mixture of step 2 by using a typical forming method, e.g., a compression method or an injection molding method.

Further, the present invention provides an R—Fe—B-based rare earth bonded magnet manufactured according to the method of manufacturing an R—Fe—B-based rare earth bonded magnet using the foregoing forming method.

Since a bonded magnet is manufactured by using the R—Fe—B-based rare earth magnetic powder according to the present invention, it may have an effect of decreasing limitations in a decrease in coercive force due to magnetic defects, such as oxidation or mechanical residual stress during a grinding process generated in a typical bonded magnet manufactured by using a method, in which rare earth magnetic powder scraps are ground and then mixed with a thermosetting resin to mold a green compact, and the green compact is cured at a temperature ranging from 100° C. to 150° C., and quality degradation due to an increase in magnetic defects of the surface generated in the curing process at a temperature ranging from 100° C. to 150° C.

Hereinafter, the present invention will be described in detail according to examples and experimental examples. However, the following examples and experimental examples are merely presented to exemplify the present invention, and the scope of the present invention is not limited thereto.

EXAMPLE 1

Preparation 1 of R—Fe—B-Based Rare Earth Magnetic Powder

Step 1: Raw Material Grinding

Process scraps generated during manufacturing processes of rare earth sintered magnets and R—Fe—B-based rare earth sintered magnet products recovered from defective products or wasted products were coarse ground as a starting raw material to a diameter ranging from 0.1 μm to 5 mm.

Step 2: Hydrogenation Process 6 g of the ground powder was charged into a tube furnace and initial vacuum of $2\times10^{-5}$ Torr or less was maintained, and the tube furnace was then filled with hydrogen up to a pressure of 1.0 atm and a temperature thereof was increased to 300° C. to complete a hydrogenation process.

Step 3: Disproportionation Process

The temperature of the tube furnace in a hydrogen atmosphere was increased to 810° C. and the temperature was maintained for 15 minutes so as to allow a disproportion process to be fully completed to obtain $\alpha$-Fe+$Fe_2B$+$NdH_x$ therethrough.

Step 4: Desorption Process

Hydrogen in the tube furnace was exhausted up to a pressure of 200 Torr after the disproportion process and the pressure was maintained for 5 minutes.

Step 5: Recombination Process

A recombination process was performed to prepare R—Fe—B-based rare earth magnetic powder while the pressure of hydrogen in the tube furnace was vacuum exhausted up to $10^{-5}$ Torr.

EXAMPLE 2

Preparation 2 of R—Fe—B-Based Rare Earth Magnetic Powder

R—Fe—B-based rare earth magnetic powder was prepared in the same manner as Example 1 except that the disproportion process of step 3 was performed for 30 minutes.

EXAMPLE 3

Preparation 3 of R—Fe—B-Based Rare Earth Magnetic Powder

R—Fe—B-based rare earth magnetic powder was prepared in the same manner as Example 1 except that the disproportion process of step 3 was performed for 60 minutes.

EXAMPLE 4

Preparation 4 of R—Fe—B-Based Rare Earth Magnetic Powder

R—Fe—B-based rare earth magnetic powder was prepared in the same manner as Example 1 except that the disproportion process of step 3 was performed for 120 minutes.

EXAMPLE 5

Preparation 5 of R—Fe—B-Based Rare Earth Magnetic Powder

R—Fe—B-based rare earth magnetic powder was prepared in the same manner as Example 1 except that hydrogen gas in the hydrogenation process of step 2 was filled up to a pressure of 0.3 Torr and the disproportion process of step 3 was performed for 60 minutes.

EXAMPLE 6

Preparation 6 of R—Fe—B-Based Rare Earth Magnetic Powder

R—Fe—B-based rare earth magnetic powder was prepared in the same manner as Example 5 except that the disproportion process of step 3 was performed for 120 minutes.

EXAMPLE 7

Preparation 7 of R—Fe—B-Based Rare Earth Magnetic Powder

R—Fe—B-based rare earth magnetic powder was prepared in the same manner as Example 5 except that the disproportion process of step 3 was performed for 180 minutes.

EXAMPLE 8

Preparation 8 of R—Fe—B-Based Rare Earth Magnetic Powder

R—Fe—B-based rare earth magnetic powder was prepared in the same manner as Example 3 except that a recombination process was performed after the disproportion process of step 3 and the desorption process of step 4 were repeated once.

EXAMPLE 9

Preparation 9 of R—Fe—B-Based Rare Earth Magnetic Powder

R—Fe—B-based rare earth magnetic powder was prepared in the same manner as Example 8 except that a recombination process was performed after the disproportion process and the desorption process were repeated 5 times.

EXAMPLE 10

Manufacturing 1 of Bonded Magnet Using R—Fe—B-Based Rare Earth Magnetic Powder

A bonded magnet was manufactured by using the R—Fe—B-based rare earth magnetic powder prepared through Example 8. The rare earth magnetic powder was ground to a diameter ranging from 50 μm to 500 μm, and 2.5 wt % of a thermosetting epoxy resin was then added thereto to prepare a compound and a rare earth bonded magnet was manufactured by using a compression method.

COMPARATIVE EXAMPLE 1

Preparation 10 of R—Fe—B-Based Rare Earth Magnetic Powder

Process scraps generated during manufacturing processes of rare earth sintered magnets and R—Fe—B-based rare earth sintered magnet products recovered from defective products or wasted products were ground as a starting raw material to a diameter ranging from 50 μm to 150 μm to prepare R—Fe—B-based rare earth magnetic powder.

COMPARATIVE EXAMPLE 2

Manufacturing 2 of Bonded Magnet Using R—Fe—B-Based Rare Earth Magnetic Powder

A bonded magnet was manufactured by using the R—Fe—B-based rare earth magnetic powder prepared through Comparative Example 1. The rare earth magnetic powder was ground to a diameter ranging from 50 μm to 500 μm, and 2.5 wt % of a thermosetting epoxy resin was then added thereto to prepare a compound and a rare earth bonded magnet was manufactured by using a compression method.

EXPERIMENTAL EXAMPLE 1

X-Ray Diffraction Analysis 1 of R—Fe—B-Based Rare Earth Magnetic Powder

Figure 2:
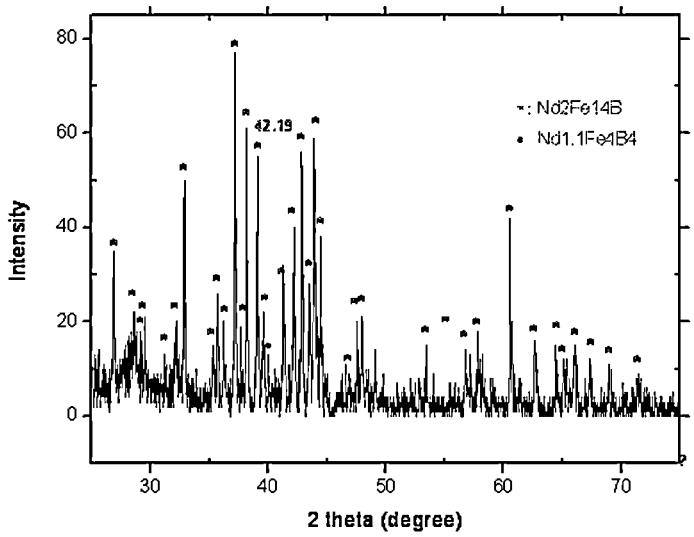
FIG. 2 is a graph obtained from X-ray diffraction analysis of R—Fe—B-based rare earth magnetic powder after performing the hydrogenation process.

In the method of preparing R—Fe—B-based rare earth magnetic powder of the present invention, powder not subjected to the hydrogenation process of Comparative Example 1 and powder subjected up to the hydrogenation process, step 2 of the present invention, were analyzed through X-ray diffraction analysis and the results thereof are presented in FIGS. 1 and 2.

As illustrated in FIGS. 1 and 2, the powder not subjected to the hydrogenation process was composed of $R_2Fe_{14}B$ and R-rich phases. However, it may be confirmed through the X-ray diffraction analysis that the powder subjected to the hydrogenation process of the present invention was combined with hydrogen through the hydrogenation process to form hydrogen compounds of $R_2Fe_{14}BH_x$ and $RH_N$. Therefore, it was confirmed that a ground product of scraps composed of $R_2Fe_{14}B$ and R-rich phases, a starting raw material, is properly combined with hydrogen through the hydrogenation process of the present invention.

EXPERIMENTAL EXAMPLE 2

X-Ray Diffraction Analysis 2 of R—Fe—B-Based Rare Earth Magnetic Powder

Figure 3:
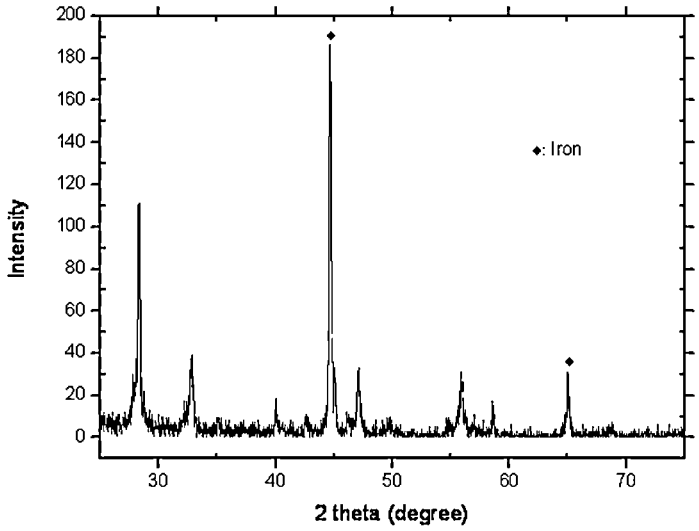
FIG. 3 is a graph obtained from X-ray diffraction analysis of R—Fe—B-based rare earth magnetic powder after performing a desorption process.

In the method of preparing R—Fe—B-based rare earth magnetic powder of the present invention, powder subjected to the desorption process of step 4 was analyzed through X-ray diffraction analysis and the results thereof are presented in FIG. 3.

As illustrated in FIG. 3, it was confirmed that recombination of α-Fe, $Fe_2B$, and $RH_x$ phases generated through the disproportionation process was not performed in the powder subjected to the desorption process. At this time, the three disproportionated phases were recombined into $R_2Fe_{14}B$+R-rich+$H_2$ constituting the initial alloy ingot during the recombination process in the preparation method of the present invention.

EXPERIMENTAL EXAMPLE 3

Figure 4:
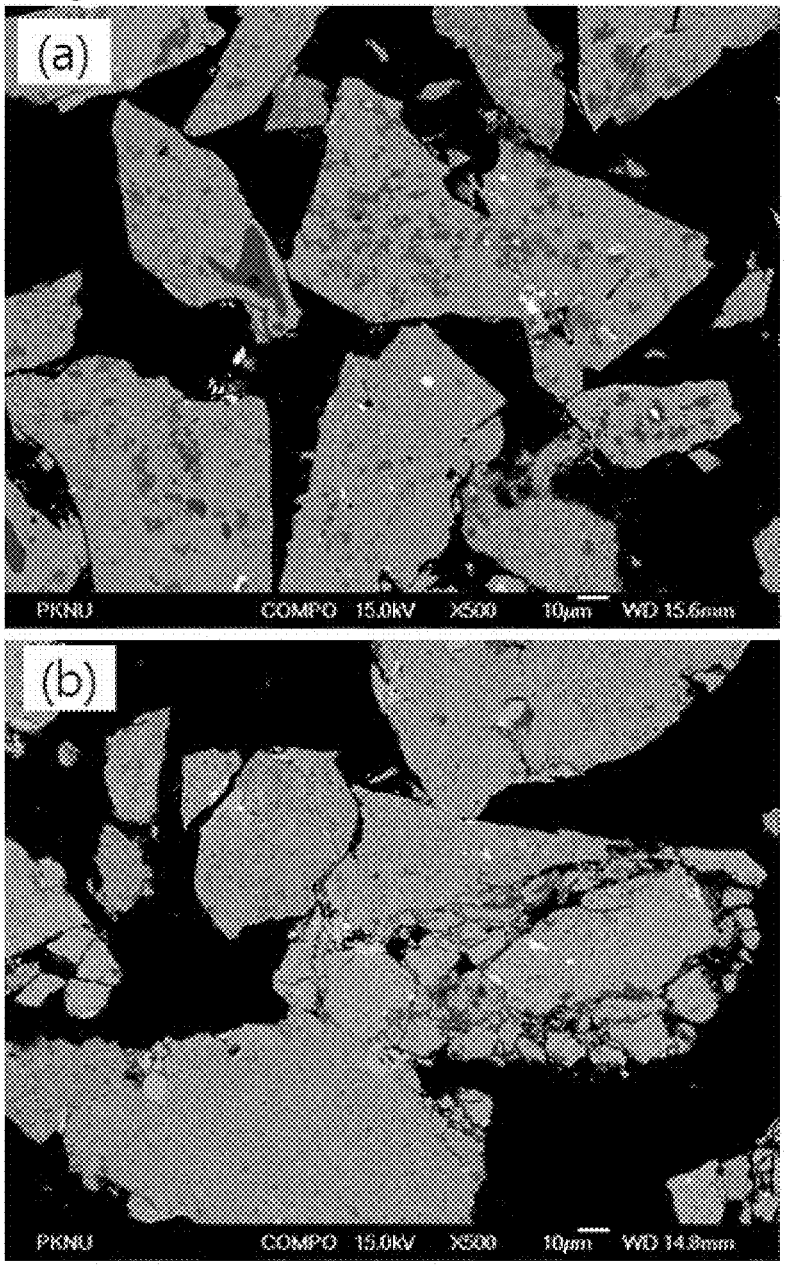
FIG. 4 is scanning electron microscope micrographs illustrating R—Fe—B-based rare earth magnetic powder subjected to a disproportionation process and R—Fe—B-based rare earth magnetic powder subjected up to the desorption process after the disproportionation process.

R—Fe—B-Based Rare Earth Magnetic Powder Analysis 1 Through Scanning Electron Microscope In the preparation method of the present invention, R—Fe—B-based rare earth magnetic powder subjected to the disproportionation process of step 3 and R—Fe—B-based rare earth magnetic powder subjected up to the desorption process of step 4 after the disproportionation process were analyzed through a scanning electron microscope and the results thereof are presented in FIG. 4.

As illustrated in FIG. 4, disproportionated phases, α-Fe, $Fe_2B$, and $RH_x$, were nonuniformly distributed in the powder subjected to the disproportionation process (see FIG. 4(*a*)). However, it may be confirmed that the three disproportionated phases were uniformly distributed in the powder subjected up to the desorption process following the disproportionation process (see FIG. 4(*b*)). Therefore, it may be understood that uniformity of the distribution of the disproportionated phases may be increased through the disproportionation process.

EXPERIMENTAL EXAMPLE 4

Figure 5:
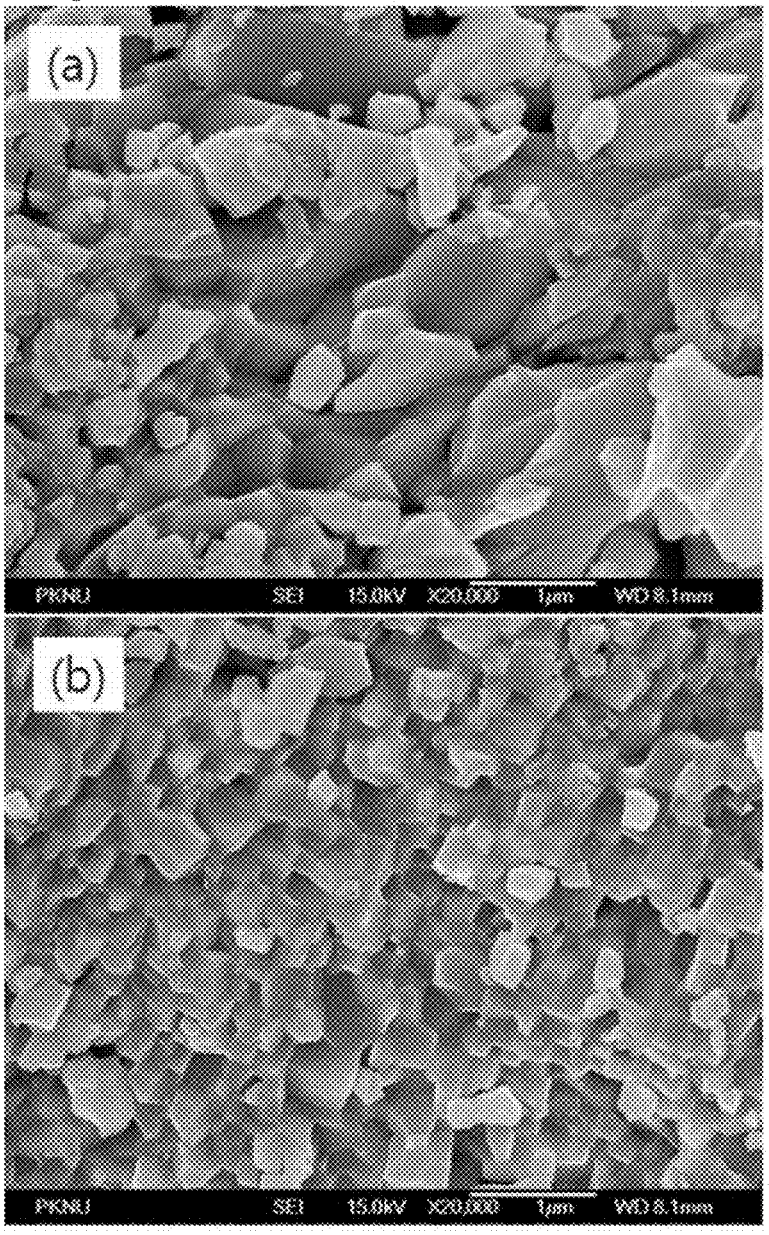
FIG. 5 is scanning electron microscope micrographs illustrating magnetic powder not repeatedly subjected to the disproportionation process and the desorption process, and magnetic powder subjected to the disproportionation process and the desorption process repeated once.

R—Fe—B-Based Rare Earth Magnetic Powder Analysis 2 Through Scanning Electron Microscope R—Fe—B-based rare earth magnetic powders prepared through Examples 3 and 8 of the present invention were analyzed through a scanning electron microscope and the results thereof are presented in FIG. 5.

As illustrated in FIG. 5, it may be understood that large particles having a particle diameter ranging from a few hundreds μm to a few mm were distributed in the magnetic powder (see FIG. 5(*a*)) prepared according to Example 3 in which the disproportionation process and the desorption process were not repeated. However, it may be understood that the magnetic powder subjected to the disproportionation process and the desorption process repeated once according to Example 8 had a particle diameter ranging from about 200 nm to 400 nm (See FIG. 5(*b*)). This corresponded to a grain size approaching 200 nm to 300 nm, a diameter of a single magnetic domain of $R_2Fe_{14}B$ as a main phase. Therefore, it may be understood from the results that coarse grains of the magnetic powder may be refined by repeatedly performing the disproportionation process and the desorption process.

EXPERIMENTAL EXAMPLE 5

Magnetic Property Analysis 1 of R—Fe—B-Based Rare Earth Magnetic Powder

The rare earth magnetic powders prepared in Examples 1 to 4 of the present invention were not aligned or aligned in a magnetic field of 1 T and magnetic properties were then measured by using a vibrating sample magnetometer, and the results thereof are presented in the following Table 1.

As illustrated in Table 1, magnetic properties were measured according to time in which the disproportionation process was performed in a condition, in which the pressure of hydrogen during the disproportionation process was 1 atm.

At this time, it may be understood that the highest coercive force may be obtained when the disproportionation process was performed for 60 minutes. Also, it may be understood that even in the case in which the disproportionation process was performed for 120 minutes, there was not much difference in coercive force in comparison to the powder subjected to the disproportionation process performed for 60 minutes. Therefore, it may be understood that the disproportionation process of the present invention may be performed for 60 minutes.

TABLE 1

| | Disproportionation process condition | | Magnetic field | Residual magnetic | Coercive |
|---|---|---|---|---|---|
| Category | Hydrogen pressure (atm) | Time (minute) | alignment presence/ absence | flux density Br (kG) | force iHc (kOe) |
| Example 1 | 1.0 | 15 | Absence | 7.20 | 9.12 |
| | | | Presence | 7.22 | 9.30 |
| Example 2 | 1.0 | 30 | Absence | 7.16 | 10.57 |
| | | | Presence | 7.19 | 10.73 |
| Example 3 | 1.0 | 60 | Absence | 7.12 | 12.05 |
| | | | Presence | 7.20 | 12.10 |
| Example 4 | 1.0 | 120 | Absence | 7.18 | 11.91 |
| | | | Presence | 7.22 | 11.98 |

EXPERIMENTAL EXAMPLE 6

Magnetic Property Analysis 2 of R—Fe—B-Based Rare Earth Magnetic Powder

The rare earth magnetic powders prepared in Examples 5 to 7 of the present invention were not aligned or aligned in a magnetic field of 1 T and magnetic properties were then measured by using a vibrating sample magnetometer, and the results thereof are presented in the following Table 2.

As illustrated in Table 2, magnetic properties were measured according to time in which the disproportionation process was performed in a condition, in which the pressure of hydrogen during the disproportionation process was 0.3 atm.

At this time, it may be understood that there was not much difference in coercive forces between the powders subjected to the disproportionation processes performed for 120 minutes and 180 minutes, respectively. Also, it may be understood that coercive forces were lower than those of the powders subjected to the disproportionation processes performed in a condition of a hydrogen pressure at 1 atm. Therefore, it may be understood that the pressure of hydrogen in the disproportionation process of the present invention, for example, may be set as 1 atm instead of 0.3 atm.

TABLE 2

| | Disproportionation process condition | | Magnetic field | Residual magnetic | Coercive |
|---|---|---|---|---|---|
| Category | Hydrogen pressure (atm) | Time (minute) | alignment presence/ absence | flux density Br (kG) | force iHc (kOe) |
| Example 5 | 0.3 | 60 | Absence | 7.11 | 6.80 |
| | | | Presence | 11.45 | 6.25 |
| Example 6 | 0.3 | 120 | Absence | 7.21 | 8.12 |
| | | | Presence | 11.40 | 7.68 |
| Example 7 | 0.3 | 180 | Absence | 7.20 | 8.50 |
| | | | Presence | 11.43 | 8.01 |

EXPERIMENTAL EXAMPLE 7

Magnetic Property Analysis 3 of R—Fe—B-Based Rare Earth Magnetic Powder

The rare earth magnetic powders prepared in Examples 3, 8, and 9 of the present invention were not aligned or aligned in a magnetic field of 1 T and magnetic properties were then measured by using a vibrating sample magnetometer, and the results thereof are presented in the following Table 3.

As illustrated in Table 3, magnetic properties were measured according to the repetition of the disproportionation process and the desorption process.

At this time, it may be understood that the highest coercive force may be obtained when the disproportionation process and the desorption process were repeated once. Also, the powder subjected to the disproportionation process and the desorption process repeated 5 times exhibited coercive force higher than that of the powder subjected to the disproportionation process and the desorption process without repetition, but exhibited a value slightly lower than that of the powder subjected to the disproportionation process and the desorption process repeated once.

Therefore, it may be understood that coercive force of the magnetic powder may be improved through the repetition of the disproportionation process and the desorption process of the present invention.

TABLE 3

| | Disproportionation/desorption process condition | | Magnetic field | Residual magnetic | Coercive |
|---|---|---|---|---|---|
| Category | Hydrogen pressure (atm/torr) | Number of repetition | alignment presence/absence | flux density Br (kG) | force iHc (kOe) |
| Example 3 | 1.0/200 | 0 | Absence | 7.12 | 12.05 |
| | | | Presence | 7.20 | 12.10 |
| Example 8 | 1.0/200 | 1 | Absence | 7.16 | 14.15 |
| | | | Presence | 7.21 | 14.20 |
| Example 9 | 1.0/200 | 5 | Absence | 7.20 | 13.75 |
| | | | Presence | 7.22 | 13.81 |

EXPERIMENTAL EXAMPLE 8

Magnetic Property Analysis 4 of R—Fe—B-Based Rare Earth Magnetic Powder

The rare earth magnetic powder prepared in Comparative Example 1 of the present invention was not aligned or aligned in a magnetic field of 1 T and magnetic properties were then measured by using a vibrating sample magnetometer, and the results thereof are presented in the following Table 4.

As illustrated in Table 4, it may be understood that rare earth magnetic powder prepared according to Comparative Example 1 had coercive force lower than those of the examples of the present invention. The reason for this is that the magnetic powder was prepared through simple grinding instead of the new HDDR process, the manufacturing method of the present invention. Therefore, it may be understood that magnetic properties may be improved by preparing magnetic powder through the manufacturing method of the present invention.

TABLE 4

| | Grinding condition | | Magnetic field alignment | Residual magnetic flux | Coercive force |
|---|---|---|---|---|---|
| Category | Grinding method | Particle diameter | presence/absence | density Br (kG) | iHc (kOe) |
| Comparative Example 1 | Hand mill | 50-150 μm | Absence | 6.00 | 8.01 |
| | | | Presence | 11.89 | 5.74 |

EXPERIMENTAL EXAMPLE 9

Magnetic Property Analysis of Bonded Magnet Manufactured from R—Fe—B-Based Rare Earth Magnetic Powder Magnetic properties of bonded magnets manufactured in Comparative Example 2 and Example 10 of the present invention were measured by using a B-H tracer and the results thereof are presented in the following Table 5.

As illustrated in Table 5, it may be understood that a bonded magnet manufactured from the magnetic powder subjected to the disproportionation process and the desorption process repeated once in the preparation method of the present invention had a relatively high coercive force in comparison to a bonded magnet manufactured from magnetic powder prepared through simple grinding.

It may be confirmed through this that the magnetic powder prepared through the manufacturing method of the present invention was excellent and the magnetic properties of the bonded magnet manufactured from this magnetic powder was excellent.

TABLE 5

| | Manufacturing condition of bonded magnet | | Residual magnetic | Coercive |
|---|---|---|---|---|
| Category | Epoxy content (wt %) | Density (g/cc) | flux density Br (kG) | force iHc (kOe) |
| Comparative Example 2 | 2.5 | 6.0 | 3.45 | 2.46 |
| Example 10 | 2.5 | 6.0 | 5.18 | 12.35 |

The invention claimed is:

1. A method of preparing R—Fe—B-based rare earth magnetic powder having improved magnetic properties, the method comprising:

coarse grinding rare earth sintered magnet products as a raw material;

performing a hydrogenation process in which a ground product obtained through the coarse grinding is charged into a tube furnace, and the tube furnace is then filled with hydrogen and a temperature of the tube furnace is increased;

performing a disproportionation process in which the temperature of the tube furnace is further increased in the same hydrogen atmosphere as that of the hydrogenation process;

performing a desorption process in which hydrogen is exhausted from an inside of the tube furnace; and performing a recombination process in which hydrogen in the inside of the tube furnace is vacuum exhausted after the desorption process is performed, wherein the recombination process is performed after the desorption process and the disproportionation process and desorption process are repeated one time.

2. The method as set forth in claim 1, wherein the rare earth sintered magnet products, are process scraps generated during manufacturing processes of rare earth magnets and R—Fe—B-based rare earth sintered magnet products recovered from defective products or wasted products.

3. The method as set forth in claim 1, wherein the rare earth sintered magnet products are ground to a diameter ranging from 0.1 μm to 10,000 μm by the coarse grinding.

4. The method as set forth in claim 1, wherein a vacuum state in the tube furnace before hydrogen is introduced in the hydrogenation process is a pressure of $1\times10^{-2}$ Torr or less.

5. The method as set forth in claim 1, wherein hydrogen in the hydrogenation process is filled to a pressure ranging from 228 Torr to 1520 Torr.

6. The method as set forth in claim 1, wherein the temperature of the tube furnace in the hydrogenation process is increased to a range of 100° C. to 400° C.

7. The method as set forth in claim 1, wherein the temperature of the tube furnace in the disproportionation process is further increased to a range of 700° C. to 900° C.

8. The method as set forth in claim 1, wherein the disproportionation process is performed for 30 minutes to 180 minutes.

9. The method as set forth in claim 1, wherein the exhaustion of hydrogen in the desorption process is performed to obtain a pressure of hydrogen ranging from 1 Torr to 400 Torr in the tube furnace at the same temperature as that of the disproportionation process.

10. The method as set forth in claim 1, wherein the desorption process of is performed for 1 minute to 30 minutes.

11. The method as set forth in claim 1, wherein the number of repetitions of the disproportionation process and the desorption process before the recombination process is in a range of one to ten.

12. The method as set forth in claim 1, wherein the vacuum exhaustion in the recombination process is performed to obtain a pressure of hydrogen in the tube furnace ranging from $10^{-5}$ Torr to $10^{-1}$ Torr.

13. The method as set forth in claim 1, wherein the prepared R—Fe—B-based rare earth magnetic powder has improved magnetic properties prepared by using the preparation method of claim 1.

14. The method as set forth in claim 13, wherein a grain diameter of the rare earth magnetic powder is in a range of 200 nm to 600 nm.

15. The method as set forth in claim 1, further comprising:

grinding the R—Fe—B-based rare earth magnetic powder to form powder;

mixing the powder with at least one of a thermosetting or thermoplastic synthetic resin to form a mixture; and molding the mixture to form a compression or injection-molded bonded magnet.

16. The method as set forth in claim 15, wherein the R—Fe—B-based rare earth magnetic powder is ground to a diameter ranging from 50 μm to 1000 μm.

17. The method as set forth in claim 15, wherein the synthetic resin is added in an amount ranging from 1 wt % to 10 wt % based on a total weight of the bonded magnet.

18. The method as set forth in claim 15, wherein a R—Fe—B based rare earth bonded magnet is manufactured.

* * * * *